US005810628A

United States Patent [19]

Trudel et al.

[11] Patent Number: 5,810,628

[45] Date of Patent: Sep. 22, 1998

[54] CIRCUIT BREAKER LINE AND LOAD TERMINAL

[75] Inventors: David J. Trudel, Southington; Joseph B. Kelaita, Jr., Bristol; Joseph M. Palmieri, Southington; Roger N. Castonguay, Terryville, all of Conn.

[73] Assignee: General Electric Company, New York, N.Y.

[21] Appl. No.: 667,778

[22] Filed: Jun. 21, 1996

[51] Int. Cl.[6] ..... H01R 4/50

[52] U.S. Cl. ..... 439/864

[58] Field of Search ..... 439/864, 790

[56] References Cited

U.S. PATENT DOCUMENTS

| | | | |
|---|---|---|---|
| 1,946,897 | 2/1934 | Carlson | 200/134 |
| 2,482,966 | 9/1949 | Cook | 439/864 |
| 2,864,071 | 12/1958 | Johnson, Jr. | 339/109 |
| 3,354,518 | 11/1967 | Hoover | 439/864 |
| 3,845,457 | 10/1974 | Riemer | 439/864 |
| 4,513,268 | 4/1985 | Seymour et al. | 335/35 |
| 4,759,726 | 7/1988 | Naylor et al. | 439/441 |
| 4,966,563 | 10/1990 | Pierce et al. | 439/729 |

FOREIGN PATENT DOCUMENTS

| | | | |
|---|---|---|---|
| 588046 | 4/1925 | France | 439/864 |
| 85256 | 5/1965 | France | 439/864 |
| 65961 | 3/1969 | Germany | 439/864 |
| 2420630 | 11/1975 | Germany | 439/864 |
| 264135 | 4/1929 | Italy | 439/864 |

*Primary Examiner*—Gary F. Paumen

*Attorney, Agent, or Firm*—Richard A. Menelly; Carl B. Horton

[57] ABSTRACT

A spring-loaded cam electrical connector is used to rapidly connect circuit breaker load terminal straps with the associated electric distribution system wire conductors. Rotation of the cam in one direction traps the end of the wire conductor between the bottom of the cam support and the circuit breaker load terminal strap to make the electrical connection while rotation of the cam in the opposite direction releases the end of the wire conductor to break the electrical connection.

6 Claims, 3 Drawing Sheets

CIRCUIT BREAKER LINE AND LOAD TERMINAL

BACKGROUND OF THE INVENTION

Residential circuit breakers such as described within U.S. Pat. No. 4,513,268 entitled "Automated Q-Line Circuit Breaker" are arranged within a load center in residences, apartment buildings and the like. The line straps at one end of the circuit breakers are positioned on the corresponding line stabs within the load centers and the load straps at the opposite end are arranged within load lugs which are manually connected with corresponding electrical distribution conductors by means of load terminal screws.

Upon initial installation of the load center, substantial time is required to manually torque each of the load terminal screws to insure tight mechanical and electrical connection between the circuit breaker load straps and the associated wire conductors.

U.S. Pat. Nos. 1,946,897 entitled "Electric Fuse Clamp", 2,864,071 entitled "Clamping Device for Electric Wires", 4,759,726 entitled "Screwless Type Electrical Terminal Block" and 4,966,563 entitled "Bus Bar Tab Connector" describe various means for attaching circuit breakers, fuses and the like to associated wire conductors. Each of the devices within the aforementioned patents require sizing the connectors in accordance with the size of the associated wire conductors. The camming arrangement disclosed in aforementioned U.S. Pat. No. 4,759,726, for example, is sized for use with printed circuit board terminals which operate at much lower currents than residential circuit breakers.

U.S. patent application Ser. No. 08/667,777 entitled "Circuit Breaker Load Strap Connector", filed Jun. 21, 1996, describes a rapid lug connector that utilizes a charged compression spring to provide torqued connection between the circuit breaker load strap and the associated wire conductor.

One purpose of the invention is to provide a circuit breaker load strap connector that is capable of handling current levels associated with residential and industrial electrical distribution circuits and can be rapidly connected with the associated wire conductors without requiring screwdrivers or similar tools to make the connection.

SUMMARY OF THE INVENTION

A spring-loaded steel or plastic cam electrical connector is used to rapidly connect circuit breaker load terminal straps with the associated electric distribution system wire conductors. The cam is configured to incorporate a tear-shaped slot having a wide end and a narrow end. Rotation of the cam in one direction traps the end of the wire conductor in contact with the circuit breaker load terminal strap by compression of the wide end of the slot against the load terminal strap. Rotation of the cam in the opposite direction positions the narrow end of the slot against the terminal strap and allows release of the end from the end of the wire conductor from the circuit breaker terminal strap connection.

DESCRIPTION OF THE PREFERRED EMBODIMENT

Figure 1:
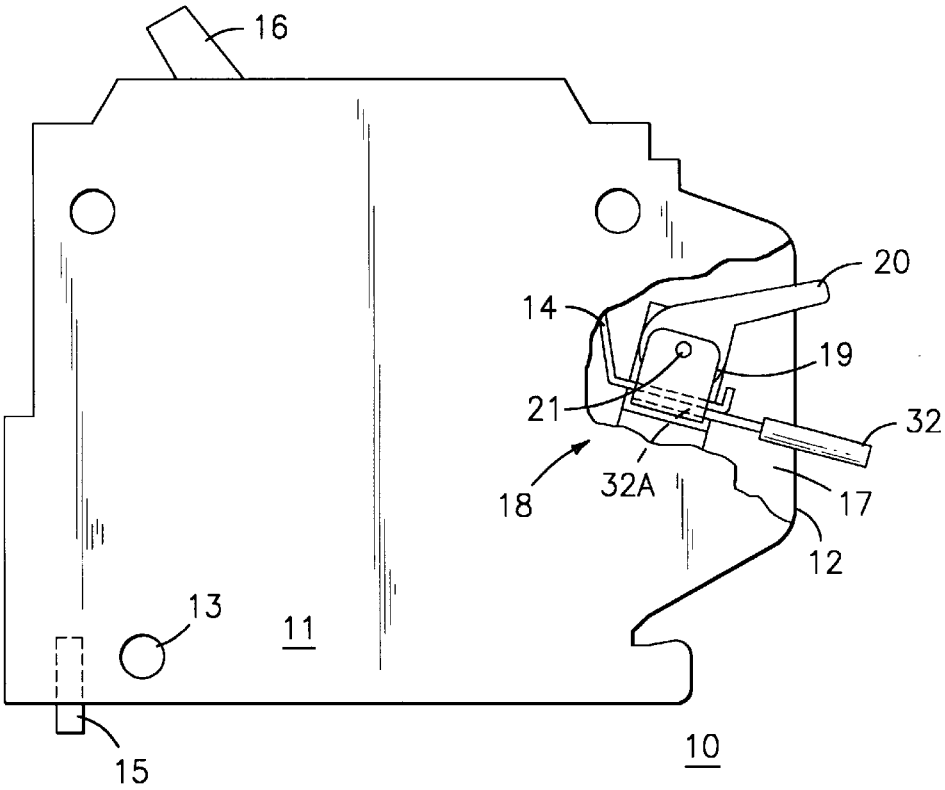
FIG. 1 is a side view of a circuit breaker embodying the spring-loaded cam connector according to the invention.

The circuit breaker 10 shown in FIG. 1 is similar to the one described within the aforementioned U.S. Pat. No. 4,513,268 and consists of an electrically-insulative top cover 11 that is attached to an electrically-insulative base 12 by means of corresponding rivets 13. Electrical connection between the load strap 14 and the line terminal connector 15 is controlled by the operating handle 16. In accordance with the invention, a terminal connector 18 is arranged within the load terminal compartment 17 for connecting with the end 32A of the wire conductor 32 which, in turn, connects with the associated electrical distribution system. The terminal connector 18 includes a cam operator 20 mounted within a U-shaped cam support 19 by means of the pivot pin 21.

Figure 2:
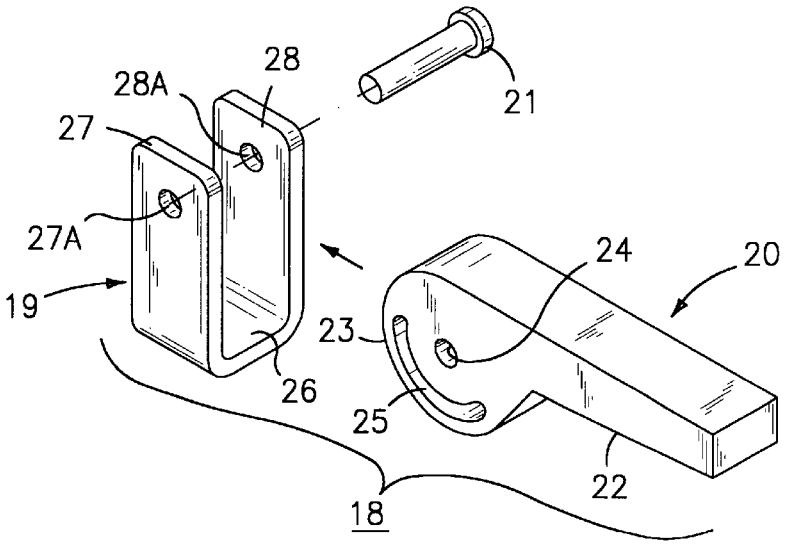
FIG. 2 is an enlarged top perspective view of the cam connector of FIG. 1 prior to assembly.
Figure 3A:
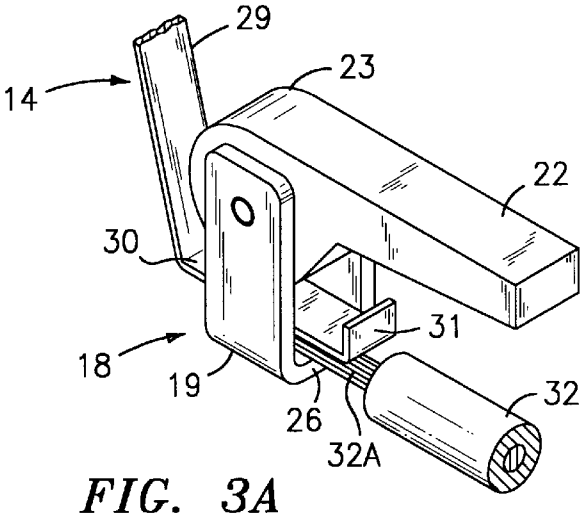
FIG. 3A is a top perspective view of the cam connector of FIG. 2 connecting a wire conductor to the circuit breaker load strap.
Figure 3B:
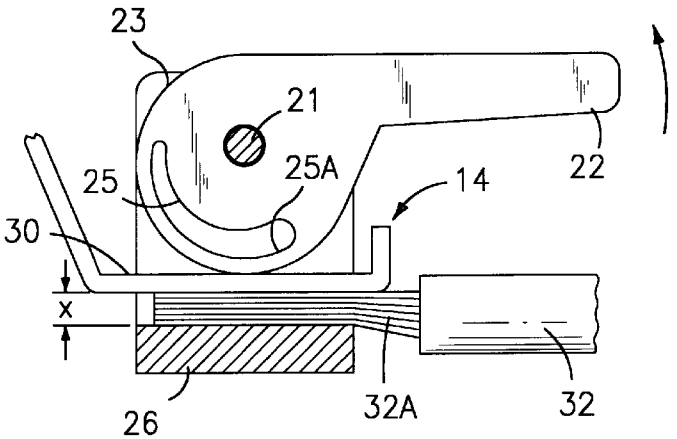
FIG. 3B is a side view in partial section of the cam connector of FIG. 3A with a part of the cam support removed to depict the spring slot in compression.
Figure 3C:
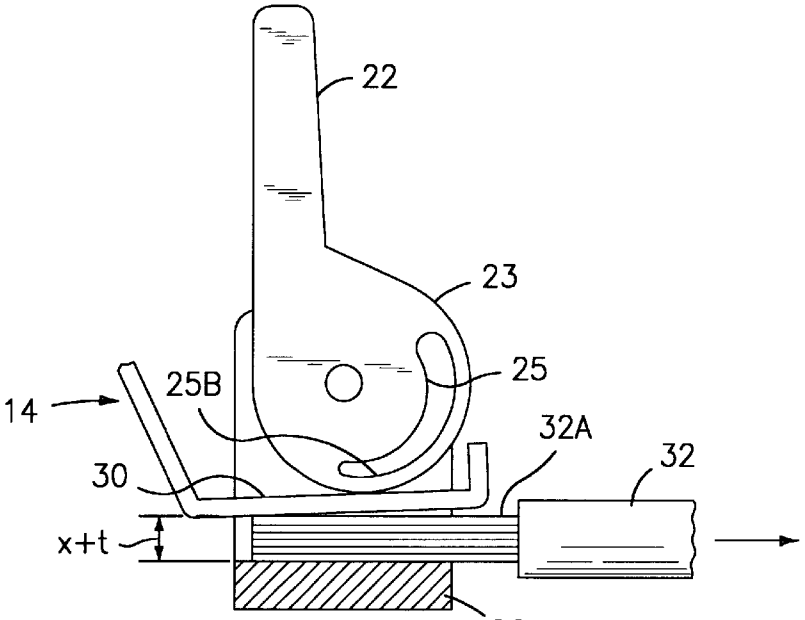
FIG. 3C is a side view in partial section of the cam connector of FIG. 3A with the spring slot out of compression.

The cam operator 20 is shown in the terminal connector 18 depicted in FIG. 2 to consist of an integrally-formed handle 22 extending from a cam 23. The thru-hole 24 extending through the cam receives the pivot pin 21 to pivotally mount the cam operator within the U-shaped support 19 by means of corresponding apertures 27A, 28A within the side arms 27, 28 respectively. The side arms are joined together by means of the base 26. An important feature of the invention is the provision of a tear-shaped elongated slot 25 formed in the cam 23 which behaves as a compression spring when the terminal connector is used to connect with the associated wire conductor 32 as shown in FIGS. 3A–3C.

The cam is formed from a metal composition having a high coefficient of elasticity that allows the tear-shaped slot 25 to have spring-like properties. In FIG. 3A, the terminal connector 18 is arranged on the front planar extension 30 of the circuit breaker load strap 14. The load strap is similar to that described in aforementioned U.S. Pat. No. 4,513,268 and includes a back part 29 connecting with the circuit breaker current-carrying components (not shown) and a front lip 31. The terminal connector 18 is positioned over the planar extension 30 of the load strap 14 such that the cam 23 contacts the extension and drives the extension against the end 32A of the wire conductor 32 and traps the end of the wire conductor against the base 26 of the cam support 19 when the handle 22 is rotated. In the connected position also depicted in FIG. 3B, the wide end 25A of the slot 25 is positioned against the front part 30 of the load strap 14 such that the force transferred from the handle through the cam 23 is transferred via the compression of the wide end 25A of the slot 25 against the front part 30 thereby compressing the end 32A of the wire conductor 32 tightly against the base 26 as indicated by the thickness x of the end 32A under compression. The force generated by compression of the wide end 25A is directed through the center of the pivot pin 21 which prevents the cam 23 from rotating until the handle 22 is again rotated in the counter-clockwise direction. When the handle 22 is next rotated in the counter-clockwise direction, as indicated in FIG. 3C, the cam 23 rotates such that the narrow end 25B abuts the front part 30 and the end 32A of the wire conductor 32 assume the thickness x+t which readily allows the end 32A to become released from between the front part 30 of the load strap 14 from the base 26 when a translatory force is applied to the wire conductor 32 in the indicated direction.

Figure 4A:
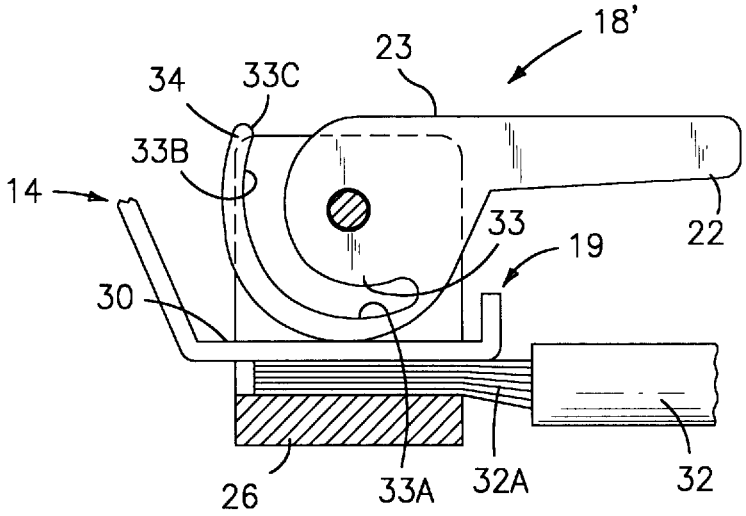
FIG. 4A is an enlarged side view of an alternate embodiment of the cam connector of FIG. 1 with the spring slot out of compression.
Figure 4B:
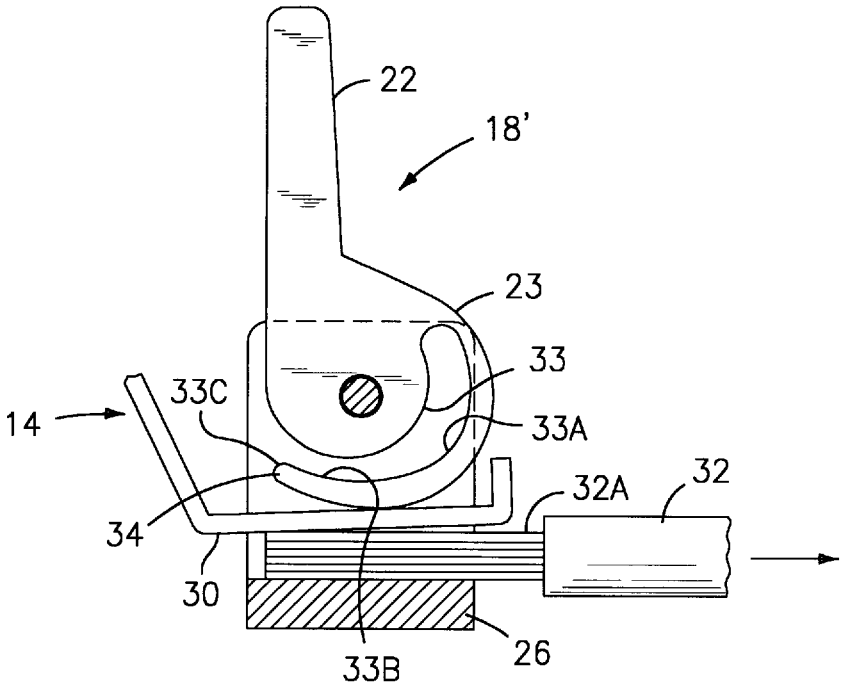
FIG. 4B is a side view of the cam connector of FIG. 4A with the spring slot in compression.

The terminal connectors 18' shown in FIGS. 4A and 4B compensate for variations in the thickness of the end 32A of the conductor 32 after the end is removed from between the front part 30 of the load terminal strap 14 and the base 26 of the support 19. The cam 23 has a similar tear-shaped slot 33 with a wide end 33A for compressing the end 32A between the front part and the base as shown in FIG. 4A. The slot 33 differs from that shown earlier by inclusion of a gap 33C formed in the edge of the narrow end 33B. This allows the bottom 34 of the cam 23 to become spring-loaded in the direction of the base 26. When the end 32A of the conductor 32 is next inserted within the terminal connector 18'0 with the handle 22 in the position depicted in FIG. 4B, the bottom 34 of the cam 23 forces the front part 30 of the load terminal strap 14 against the end 32A of the conductor 32 into compression between the front part and the base to compensate for the reduced diameter of the end of the conductor. With the narrow end 33B over the front part of the load terminal, the spring-loaded bottom 34 of the cam compensates for the reduced diameter and automatically allows for tolerance variations between different size initial wire conductor diameters as well as the differences caused by removal and re-insertion.

A simple and economical terminal connector has herein been described which allows rapid connection and disconnection between a circuit breaker load strap and associated wire conductors without requiring use of a tool during the connection and disconnection process.

We claim:

1. A circuit breaker having facility for rapid connection with and disconnection from an electrical wire conductor comprising:

an electrically-insulative cover connected with an electrically-insulative plate;

a first terminal connector at one end of said cover and plate for connection with an electrical distribution system;

a second terminal connector at an opposite end of said cover and plate for connection with said electrical distribution system;

an operating handle extending from said cover and said plate and arranged for electrical connection and disconnection between said first and second terminal connectors;

a wire connector associated with said second terminal connector, said wire connector comprising:

a U-shaped support having a pair of side arms upstanding from a support base;

a cam pivotally arranged intermediate said side arms, said cam including a slot formed in said cam, said slot defines a first end and a second end, said first end being wider than said second end allowing said cam to provide various compressive force against said wire terminal and said wire conductor; and an operating handle at one end of said cam for rotating said cam against a wire terminal, whereby said cam traps a wire conductor between a bottom of said wire terminal and said base for mechanical and electrical connection between said wire conductor and said wire terminal.

2. The circuit breaker of claim 1 wherein said first end of said slot is oriented toward a first end of said wire terminal.

3. The circuit breaker of claim 1 wherein said cam comprises plastic.

4. The circuit breaker of claim 1 wherein said cam comprises metal.

5. The circuit breaker of claim 1 wherein said slot defines a tear-shaped configuration.

6. The circuit breaker of claim 1 wherein said wire terminal comprises a circuit breaker terminal strap.

* * * * *